US009243505B2

(12) United States Patent
Vassiliev et al.

(10) Patent No.: US 9,243,505 B2
(45) Date of Patent: Jan. 26, 2016

(54) SEAL ARRANGEMENT

(75) Inventors: Vladimir Vassiliev, Turgi (CH); Fulvio Magni, Nussbaumen (CH); Sergey Anatolievich Chernyshev, Lubertsy (RU); Victor Vladimirovich Odinokov, Moscow (RU)

(73) Assignee: ALSTOM TECHNOLOGY LTD, Baden (CH)

( * ) Notice: Subject to any disclaimer, the term of this patent is extended or adjusted under 35 U.S.C. 154(b) by 1091 days.

(21) Appl. No.: 13/288,094

(22) Filed: Nov. 3, 2011

(65) Prior Publication Data

US 2012/0122045 A1 May 17, 2012

(30) Foreign Application Priority Data

Nov. 9, 2010 (CH) ..... 1877/10

(51) Int. Cl.

| | |
|---|---|
| ***F23D 14/46*** | (2006.01) |
| ***F16J 15/02*** | (2006.01) |
| ***F01D 9/02*** | (2006.01) |
| ***F01D 11/04*** | (2006.01) |
| ***F23R 3/60*** | (2006.01) |

(52) U.S. Cl.

CPC ..... *F01D 9/023* (2013.01); *F01D 11/04* (2013.01); *F23R 3/60* (2013.01); *F23R 2900/00012* (2013.01); *F23R 2900/03342* (2013.01)

(58) Field of Classification Search

CPC ..... F01D 9/023; F01D 11/04; F23R 3/60; F23R 2900/00012; F23R 2900/03342; F16J 15/006; F16J 15/44; F16J 15/442–15/447

USPC ..... 60/39.37, 737–760

See application file for complete search history.

(56) References Cited

U.S. PATENT DOCUMENTS

| | | | | |
|---|---|---|---|---|
| 5,560,198 | A * | 10/1996 | Brewer et al. | 60/766 |
| 5,957,463 | A | 9/1999 | Inamura | |
| 7,597,329 | B2 | 10/2009 | Yasuda | |
| 7,788,932 | B2 | 9/2010 | Kunitake et al. | |

(Continued)

FOREIGN PATENT DOCUMENTS

| | | | |
|---|---|---|---|
| CN | 1193689 | A | 9/1998 |
| CN | 101220783 | A | 7/2008 |
| CN | 101287898 | A | 10/2008 |
| EP | 2 058 475 | A2 | 5/2009 |

(Continued)

OTHER PUBLICATIONS

European Patent Office, European Search Report in Swiss Patent Application No. 1877/2010 (Mar. 1, 2011).

(Continued)

*Primary Examiner* — Gerald L Sung
*Assistant Examiner* — Stefan Ibroni
(74) *Attorney, Agent, or Firm* — Buchanan Ingersoll & Rooney PC

(57) ABSTRACT

A seal arrangement for a silo combustor includes a first casing and a second casing each forming a passageway for a gas, an end portion of the first casing being disposed radially inside an end portion of the second casing such that the first and the second casing form an overlapping region having a radial gap. A segmented seal has at least two adjacent segments disposed in the overlapping region so as to seal the radial gap, wherein the first casing includes at least one opening disposed in a region between the at least two adjacent segments.

7 Claims, 4 Drawing Sheets

(56) References Cited

U.S. PATENT DOCUMENTS

| | | | |
|---|---|---|---|
| 8,069,673 | B2 | 12/2011 | Kunitake et al. |
| 8,166,764 | B2 | 5/2012 | Chokshi et al. |
| 2005/0262845 | A1 | 12/2005 | Martling |
| 2008/0164660 | A1 | 7/2008 | Yasuda |
| 2009/0072497 | A1 | 3/2009 | Kunitake et al. |
| 2009/0081027 | A1 | 3/2009 | Khanin et al. |
| 2009/0120096 | A1 | 5/2009 | Tuthill |
| 2010/0031665 | A1 | 2/2010 | Chokshi et al. |
| 2010/0077761 | A1 | 4/2010 | Johnson et al. |

FOREIGN PATENT DOCUMENTS

| | | | |
|---|---|---|---|
| EP | 2 148 139 | A2 | 1/2010 |
| JP | 2005005888 | A | 1/2005 |
| TW | 200923198 | A | 6/2009 |

OTHER PUBLICATIONS

Office Action issued on Mar. 24, 2015, by the Taiwanese Patent Office in corresponding Taiwan Patent Application No. 100140739, and an English Translation of the Office Action. (10 pages).

* cited by examiner

SEAL ARRANGEMENT

CROSS REFERENCE TO PRIOR APPLICATIONS

Priority is claimed to Swiss Application No. CH 01877/10, filed Nov. 9, 2010, the entire disclosure of which is hereby incorporated by reference herein.

FIELD

The present invention relates to a seal arrangement for a silo combustor and to a silo combustor incorporating such a seal arrangement.

BACKGROUND

A silo-type combustor usually comprises a combustion chamber, which is supplied with a fuel from above and compressed air, and a hot gas casing through which the hot combustion products are supplied from the combustion chamber to a turbine. The hot gases expand through the turbine.

The compressed air is supplied to the combustion chamber through an annular channel, which surrounds the combustor casing. The flow of hot gases and the flow of compressed air are therefore in opposing directions. The compressed air has further the function of cooling the combustor chamber casing and the hot gas casing.

The lower part of the combustion chamber is called the combustor inner liner (CIL). The combustor inner liner and the hot gas casing have an overlap, where the tip of the combustor inner liner is located inside of the upper part of the hot gas casing. In order to avoid mechanical contact and resulting fretting a gap is provided between the combustor inner liner and the hot gas casing. As the compressed air is at a higher pressure than the hot gases flowing through the combustor inner liner and the hot gas casing, the pressure difference would cause leakage of compressed air from the annular channel into the hot gas flow, thus reducing the amount of air available for combustion. A seal is therefore provided in the gap to prevent any leakage.

The seal consists of a set of segments, which may or may not overlap. One seal design is called a belt seal. In this seal arrangement the segments are assembled circumferentially around the casing, whereby the individual segments are assembled with overlap and tightened by a spring. Their connection allows some movement relative to each other, and therefore they form a flexible structure, which accommodates the possible deformation of the combustor inner liner and the hot gas casing due to thermal expansion. Hooks welded onto the hot gas casing hold the belt seal segments. The interfaces between the seal segments are circumferentially located on the hot gas casing at the same positions as the hooks.

The belt seal structure accommodates a deformation of the combustor casing due to thermal expansion and a resulting variation in the radial gap between the combustor inner liner and the hot gas casing. The overlapping sections of the belt seal substantially prevent leakage past the seal in the axial direction. There are however still small gaps between the segments, which lead to leakages in the radial direction. The amount of leakage air is small and has no appreciable impact on the combustion air supply. These leakages can however, due to vortex formation, cause ingestion of hot gas into the gap between the combustor inner liner and the hot gas casing. This results in local overheating. This overheating may occur on the combustor inner liner as well as on the hot gas casing, in the same position where the holding hooks and the interface between the segments is located. These hot spots lead to increased oxidation and a reduced life of the combustor inner liner and of the hot gas casing.

SUMMARY OF THE INVENTION

An embodiment of the present invention provides a seal arrangement for a silo combustor. A first casing and a second casing each form a passageway for a gas, an end portion of the first casing being disposed radially inside an end portion of the second casing such that the first and the second casing form an overlapping region having a radial gap. A segmented seal has at least two adjacent segments disposed in the overlapping region so as to seal the radial gap, wherein the first casing includes at least one opening disposed in a region between the at least two adjacent segments.

BRIEF DESCRIPTION OF THE DRAWINGS

The present invention will be described in even greater detail below based on the exemplary figures. The invention is not limited to the exemplary embodiments. Other features and advantages of various embodiments of the present invention will become apparent by reading the following detailed description with reference to the attached drawings which illustrate the following.

DETAILED DESCRIPTION

An embodiment of the present invention provides an improved seal arrangement for a silo combustor to reduce the local overheating associated with the ingestion of hot gas into the overlapping region between the combustor inner liner and the hot gas casing.

According to an embodiment of the invention a seal arrangement for a silo combustor comprises a first casing forming a passageway for a gas and a second casing forming a passageway for a gas, whereby an end portion of the first casing is positioned radially inside of and overlapped by an end portion of the second casing, whereby a segmented seal is positioned to seal a radial gap between the casings in the overlapping portion. The first casing is provided with at least one opening in the region between two adjacent segments of the segmented seal.

Cool air, which leaks through a gap between adjacent segments of the segmented seal, will not cause a problem, if it can be directed appropriately without inducing ingestion of hot gas into the overlapping region of the first and second casing. An embodiment of the invention provides at least one opening in the first casing, air which leaks through a radial gap between two adjacent seal segments can flow radially through the opening in the first casing into the passageway for hot gases. As the leakage air flows directly into the hot gas path, vortex formation in the overlapping region of the first and second casing is minimized. Therefore local overheating of the first and second casings is prevented. Furthermore the provision of the opening allows the leakage air to flow into and mix with the axially flowing hot gas. This provides additional cooling of the casings.

According to one embodiment of the invention a silo combustor comprises a seal arrangement. The first casing is in this embodiment a combustor inner liner and the second casing is a hot gas casing.

In an embodiment, the at least one opening in the wall of the combustor inner liner in the region between two adjacent segments of the segmented seal enables compressed air, which leaks though gaps between the seal segments, to flow radially into the hot gas flow in the combustor.

The above and other embodiments, features and advantages of the invention will become more apparent from the following description of certain preferred embodiments thereof, when taken in conjunction with the accompanying drawings.

Figure 1:
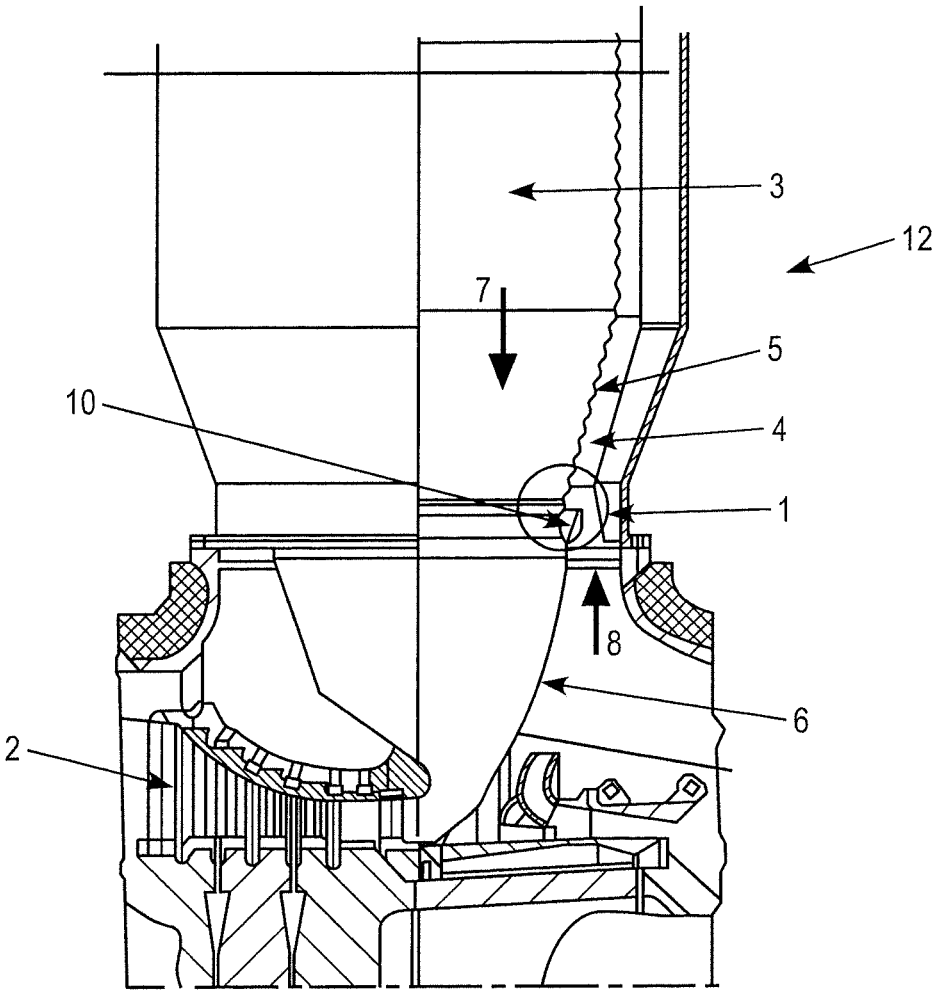
FIG. 1 a silo combustor according to the invention.

Referring to FIG. 1 a silo combustor 12 is shown. A silo-type combustor is supplied with compressed air and a fuel, whereby the combustion products in the combustor 12 are subsequently supplied to a turbine 2. The hot gases expand through and drive the turbine 2.

The compressed air for combustion is supplied through an annular channel 4, which surrounds the combustor casing 5, and upper part of casing 6. The flow of hot gases 7 and the flow of compressed air 8 are therefore in opposing directions, as can be seen in FIG. 1. These flows are substantially in the combustor 12 axial direction. The compressed air has further the function of cooling the combustor casings 5,6.

A first casing 5 of the combustor is called the combustor inner liner, which forms a lower part of the combustion chamber 3. A second casing 6 of the combustor is called a hot gas casing, which forms a passageway for supplying hot combustion gases to the turbine 2. The combustor inner liner 5 and the hot gas casing 6 have an overlap, where an end portion 19 of the combustor inner liner 5 is located inside of the upper part of the hot gas casing 6. A radial gap 9 is provided between the combustor inner liner 5 and the hot gas casing 6 in the overlapping region 10. This gap 9 is provided in order to avoid mechanical contact and resulting fretting between the combustor inner liner 5 and the hot gas casing 6. This mechanical contact would arise though deformation of the casings 5,6 due to thermal expansion.

The combustor inner liner 5 and the hot gas casing 6 are radially surrounded by the annular channel 4, which supplies compressed air to the combustor 12. As the compressed air in the channel 4 is at a higher pressure than the hot gases flowing through the combustor inner liner 5 and the hot gas casing 6, the pressure difference causes a leakage of compressed air into the hot gas flow 7, thus reducing the amount of air available for combustion. A segmented seal 11 is therefore provided in the radial gap 9 formed between the end portion of the combustor inner liner 5 and the end or upper portion of the hot gas casing 6 to minimize any leakage and to accommodate deformation of the casings 5, 6.

Figure 2:
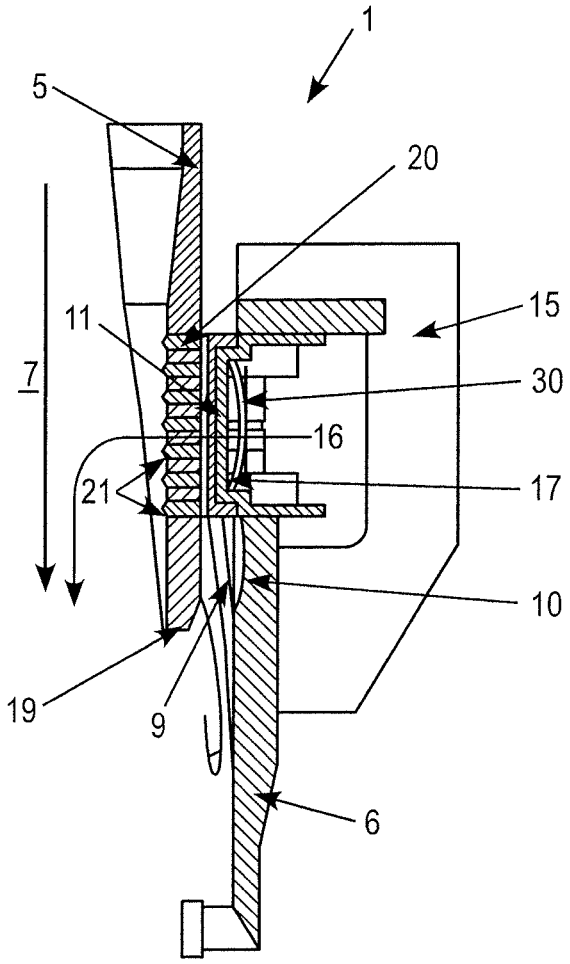
FIG. 2 a cross section of a seal arrangement according to the invention.
Figure 3A:
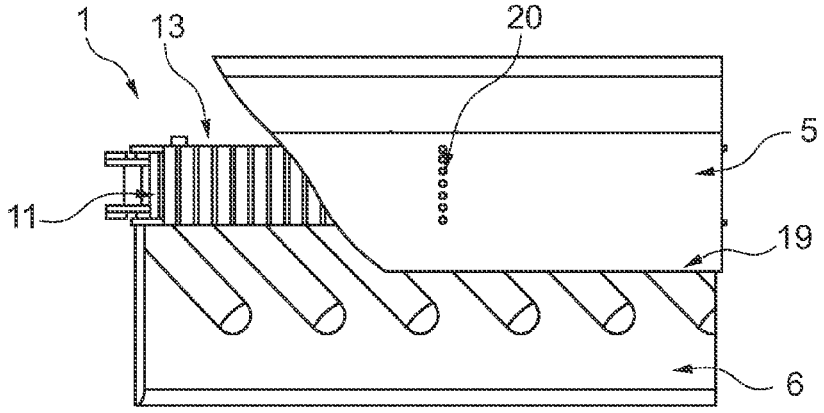
FIGS. 3*a*,3*b*,3*c* side views of a seal arrangement according to the invention, and FIGS. 4*a*,4*b* a cross section of a prior art seal arrangement.
Figure 3B:
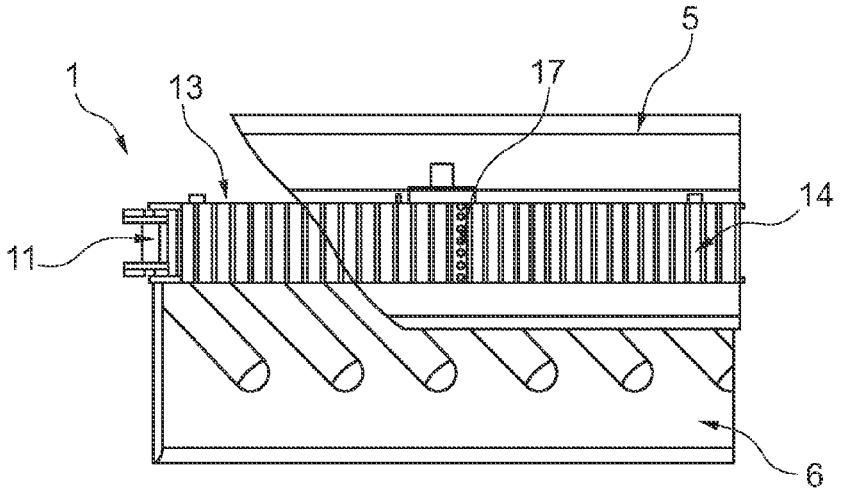
Figure 3C:
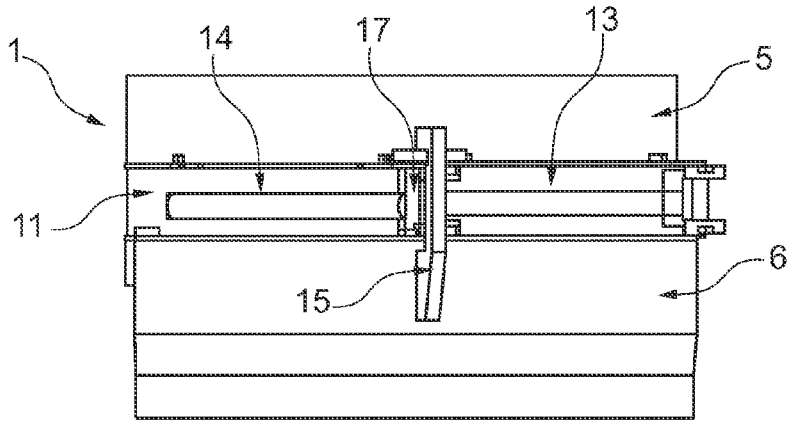

According to one embodiment of the invention a seal arrangement 1 for sealing this radial gap is shown schematically in FIGS. 2 and 3. In this seal arrangement 1 the seal segments are assembled circumferentially around the combustor inner liner 5, whereby the individual segments are assembled with or without overlap and tightened by a spring 30. This is known as a belt seal. In the FIGS. 3*a*, 3*b*, 3*e* only two segments 13, 14 are shown. The connection of the segments 13, 14 allows some movement relative to each other. Therefore the segments 13, 14 form a flexible structure, which accommodates the possible deformation of the combustor inner liner 5 and the hot gas casing 6 due to thermal expansion. The seal segments 13, 14 are held by hooks 15 welded onto the hot gas casing. The interfaces 17 between the seal segments are circumferentially located on the combustor inner liner 5 at the same positions as hooks 15. In the FIGS. 3*a* and 3*b* the seal arrangement 1 is viewed from inside the hot gas casing 6. A first 13 and second 14 seal segment, which form part of the segmented seal, are shown. In FIG. 3*c* the seal arrangement 1 is viewed from outside of the hot gas casing 6. A hook 15 is located at the interface between the first and second segment 13, 14 and is fixed to the hot gas casing 6.

The seal arrangement 1 accommodates a deformation of the combustor casing 5, 6 due to thermal expansion and a resulting variation in the radial gap between the combustor inner liner 5 and the hot gas casing 6. The overlapping sections of the seal 11 substantially prevent leakage past the segmented seal 11 in the axial direction. There are however still small gaps at the interface 17 between adjacent segments 13, 14, which lead to leakages in the radial direction as depicted by arrow 16 in FIG. 2. The amount of leakage air is small and has no appreciable impact on the combustion air supply. These leakages can however cause ingestion of hot gas into the gap 9 between the combustor inner liner 5 and the hot gas casing 6. This results in local overheating. This overheating may occur on the combustor inner liner 5 as well as on the hot gas casing 6, in the same position where the holding hooks 15 and the interface 17 between the segments 13, 14 is located. These hot spots lead to increased oxidation and a reduced life of the combustor inner liner and of the hot gas casing.

Figure 4B:
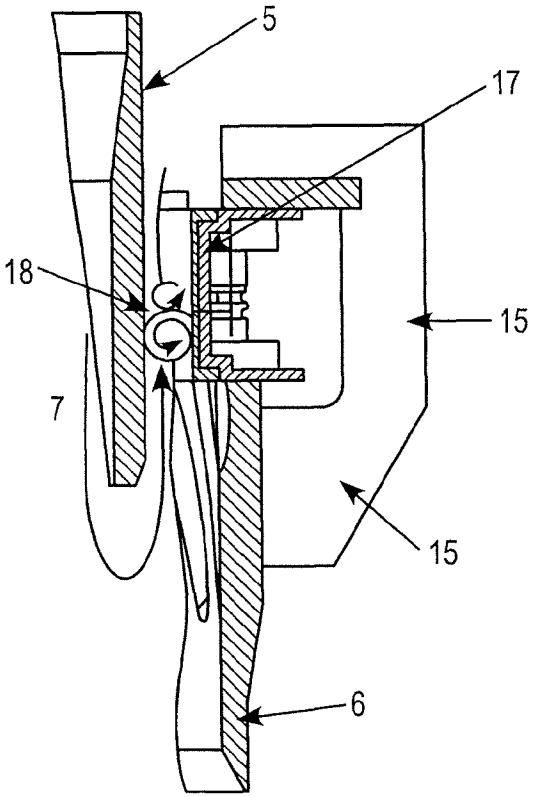
FIG. 4b Prior Art
Figure 4A:
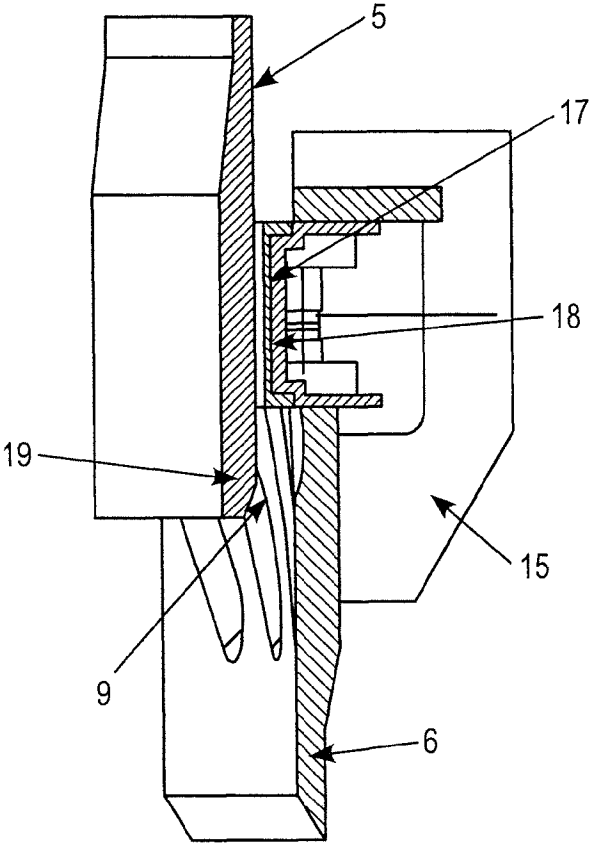
FIG. 4a Prior Art

In FIG. 4*a* a cross section of a prior art seal arrangement is shown in order to explain the invention. A segmented seal 11 substantially closes the radial gap 9 between the combustor inner liner 5 and the hot gas casing 6. FIG. 4*b* shows a similar cross section where the gap between the segmented seal 11 and the combustor inner liner 5 has been exaggerated for purposes of explanation. The leakage air through the radial gap at the interface 17 between adjacent seal segments hits the wall of the combustor inner liner 5 and creates a three-dimensional vortex flow 18. The vortices suck the hot gases into the overlapping region 10 resulting in local overheating.

Referring now to back to FIGS. 2 and 3, according to one embodiment of the invention, the combustor inner liner 5 is provided with at least one opening 20 in the region between two adjacent segments 13, 14 of the segmented seal 11. The at least one opening 20 in the combustor inner liner 5 is located preferably directly opposite the gap at the interface 17 between the segments 13, 14 through which compressed air may leak. The at least one opening 20 allows the leaked compressed air to flow though the wall of the combustor inner liner 5 into the hot gas passage 6. As the leakage air flows directly into the hot gas path, vortex formation in the overlapping region 10 of the combustor inner liner 5 and the hot gas casing 6 is minimized. Therefore local overheating in this region is prevented. Furthermore, the provision of the at least one opening 20 allows the leakage air to flow into and mix with the axially flowing hot gas 7. This provides additional cooling of the metal casings 5, 6, reducing oxidation and increasing the life of the components. The thermal distribution in the casings 5, 6 is homogenized due to the removal of the hot spots, which reduces deformation and reduces the risks of contact and fretting.

The segmented seal 11 is made up of a plurality of segments which surround the combustor inner liner 5 in the circumferential direction, whereby at least one opening 20 in the combustor inner liner 5 is respectively provided in the region of, and preferably directly opposite, each interface 17 between adjacent seal segments. The at least one opening 20 may be in the form of a plurality of holes 21 extending radially through the combustor inner liner 5. The leaking compressed air would in this case be directed radially into the axially flowing hot gases 7, thereby increasing turbulence and mixing and thus cooling of the hot gases flowing through the combustor inner liner 5. The holes 21 may however have an axial and/or circumferential component, which would encourage film cooling of the combustor inner liner.

Alternatively the opening is in the form of a slot extending in the axial direction.

The holes 21 or slot should not extend further in the axial direction than the width of the segmented seal 11 in the axial direction.

The cross-sectional area of the at least one opening 20 is preferably designed such that the mass flow through the opening 20 is equal to the leakage flow rate through the interface 17 between two adjacent seal segments opposite the opening 20.

The invention is applicable to all seal arrangements whereby a conduit is made from two sections with an axially overlapping portion, whereby a seal is required to seal a radial gap between the two sections at the overlapping portion. Particularly, the description when referring to a combustor inner liner and hot gas casing is not limited thereto, but to a first and second casing accordingly forming a passageway.

The preceding description of the embodiments according to the present invention serves only an illustrative purpose and should not be considered to limit the scope of the invention. Particularly, in view of the preferred embodiments, different changes and modifications in the form and details can be made without departing from the scope of the invention. Accordingly the disclosure of the current invention should not be limiting. The disclosure of the current invention should instead serve to clarify the scope of the invention which is set forth in the following claims.

While the invention has been described with reference to particular embodiments thereof, it will be understood by those having ordinary skill the art that various changes may be made therein without departing from the scope and spirit of the invention. Further, the present invention is not limited to the embodiments described herein; reference should be had to the appended claims.

LIST OF REFERENCE NUMERALS

1 Seal arrangement
2 Turbine
3 Combustion chamber
4 Annular channel
5 First casing
6 Second casing
7 Hot gas flow passage
8 Compressed air flow
9 Radial gap
10 Overlapping region
11 Segmented seal
12 Silo combustor
13 First seal segment
14 Second seal segment
15 Hook
16 Radial direction
17 Interfaces between segments
18 Vortex flow
19 At least one opening
20 Holes
30 Spring

What is claimed is:

1. A seal arrangement for a silo combustor comprising:

a first casing and a second casing each forming a passageway for a hot gas flow;

an annular channel surrounding the first casing and the second casing and forming a passageway for compressed air flow;

an end portion of the first casing being disposed radially inside an end portion of the second casing such that the first and the second casing form an overlapping region having a radial gap; and a segmented seal having at least two adjacent segments disposed in the overlapping region so as to seal the radial gap, wherein the first casing includes a plurality of opening disposed in a region between the at least two adjacent segments, the plurality of openings disposed in at least one axially extending region of the first casing corresponding to a location of a width of the segmented seal in an axial direction and disposed opposite a gap between the at least two adjacent segments, the plurality of openings are not arranged in the remaining axially extending regions of the first casing.

2. The seal arrangement as recited in claim 1, wherein the plurality of openings includes holes or slots.

3. The seal arrangement as recited in claim 1, wherein the plurality of openings includes a series of holes extending radially through the first casing.

4. The seal arrangement as recited in claim 1, wherein at least one of the first casing and the second casing include a metal.

5. The seal arrangement as recited in claim 1, wherein the segmented seal includes a belt seal having a plurality of connected segments and a spring configured to tighten the belt seal in a circumferential direction.

6. The seal arrangement as recited in claim 1, wherein a cross-sectional area of the plurality of openings is configured such that a mass flow rate of gas through the plurality of openings is equal to a leakage flow rate through the gap between the at least two adjacent segments.

7. A silo combustor comprising:

a seal arrangement including:

a combustor inner lining and a hot gas casing each forming a passageway for a gas;

an annular channel surrounding the inner lining and the hot gas casing and forming a passageway for compressed air flow;

an end portion of the combustor inner lining being disposed radially inside an end portion of the hot gas casing such that the combustor inner lining and the hot gas casing form an overlapping region having a radial gap;

and a segmented seal having at least two adjacent segments disposed in the overlapping region so as to seal the radial gap, wherein the combustor inner lining includes a plurality of openings disposed in a region between the at least two adjacent segments, the plurality of openings disposed in at least one axially extending region of the first casing corresponding to a width of the segmented seal in an axial direction and disposed opposite a gap between the at least two adjacent segments, the plurality of openings are not arranged in the remaining axially extending regions of the first casing.

* * * * *